US007185760B2

(12) United States Patent
Schauer et al.

(10) Patent No.: US 7,185,760 B2
(45) Date of Patent: Mar. 6, 2007

(54) NON-CONTACT PROTECTIVE PACKAGING FOR SURFACE-SENSITIVE ARTICLES

(75) Inventors: Ronald Schauer, Gilroy, CA (US); Jim Junshi Wang, Palo Alto, CA (US); Hong Wang, Cupertino, CA (US); Brian West, San Jose, CA (US); Yongxiang He, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 37 days.

(21) Appl. No.: 10/460,627

(22) Filed: Jun. 11, 2003

(65) Prior Publication Data

US 2004/0251160 A1 Dec. 16, 2004

(51) Int. Cl.
*B65D 73/00* (2006.01)

(52) U.S. Cl. ..... 206/481; 206/477

(58) Field of Classification Search ..... 206/426, 206/477, 478, 490, 486, 481, 483, 521, 525, 206/303, 349, 588, 305, 306, 418–419, 583, 206/592, 701, 722; 220/319, 574, 640, 254.2, 220/255

See application file for complete search history.

(56) References Cited

U.S. PATENT DOCUMENTS

| | | | | |
|---|---|---|---|---|
| 3,865,953 | A * | 2/1975 | Peters | 206/521 |
| 4,101,031 | A * | 7/1978 | Cromie | 206/588 |
| 4,144,967 | A * | 3/1979 | Craven et al. | 206/477 |
| 4,206,845 | A * | 6/1980 | Christian | 206/508 |
| 4,491,225 | A * | 1/1985 | Baillod | 206/521 |
| 4,832,612 | A * | 5/1989 | Grabbe et al. | 206/722 |
| 5,099,991 | A | 3/1992 | Kitagawa et al. | 206/328 |
| 5,316,149 | A | 5/1994 | Tate | 206/584 |
| 5,626,229 | A | 5/1997 | Dickie et al. | 206/522 |
| 5,628,402 | A | 5/1997 | Dickie et al. | 206/521 |
| 5,653,339 | A * | 8/1997 | Dobson | 206/419 |
| 5,971,167 | A * | 10/1999 | Finbow | 206/426 |
| 6,047,833 | A * | 4/2000 | Salomon | 206/486 |
| 6,408,598 | B1 | 6/2002 | Stockley, III | 53/433 |
| 2002/0064319 | A1 | 5/2002 | Tanaka et al. | 383/3 |
| 2003/0098253 | A1* | 5/2003 | You et al. | 206/477 |

FOREIGN PATENT DOCUMENTS

| | | |
|---|---|---|
| EP | 1170225 | 1/2002 |
| JP | 11189219 | 7/1999 |
| WO | WO 8302932 | 9/1983 |
| WO | WO 0220359 | 3/2002 |

* cited by examiner

*Primary Examiner*—Luan K. Bui
(74) *Attorney, Agent, or Firm*—Shirley L. Church

(57) ABSTRACT

Disclosed herein is a non-contact package useful when an article to be stored or shipped in the package includes a sensitive surface, the performance of which will be detrimentally affected if the sensitive surface is contacted with a nominal amount of mechanical force. A fluid environment which does not produce sufficient mechanical force to detrimentally affect the sensitive surface may be used in contact with the sensitive surface to prevent an undesirable chemical reaction on the sensitive surface. A fluid environment may also be used inside the package to support surrounding walls of the package so that such walls do not contact the sensitive surface and/or to dissipate force applied to the exterior of the package so that the sensitive surface will not be damaged. The more advantageous embodiments of the non-contact packaging not only protect sensitive surfaces of articles within the packaging during storage and shipping of the package, but also reduce the possibility that sensitive surfaces of the article will be damaged by contact with the packaging material during removal of the article from the package.

3 Claims, 10 Drawing Sheets

NON-CONTACT PROTECTIVE PACKAGING FOR SURFACE-SENSITIVE ARTICLES

BACKGROUND OF THE INVENTION

1. Field of the Invention

The present invention pertains to packaging and to a method of using the packaging to protect sensitive surfaces of articles during shipping and handling. The packaging is useful when at least one surface of the article should not be contacted during shipping, and may be useful during handling of the article prior to placement of the article in the location of its intended use.

2. Brief Description of the Background Art

Various packaging has been developed to protect an article during shipment. Blister, bubble, and heat-shrinkable packaging which holds the article in position during shipment and protects the article from an exterior environment has been particularly popular. Examples of such packaging are described in trade journal publications and patents. For purposes of illustration a number of examples follow. U.S. Pat. No. 5,099,991, issued Mar. 31, 1992 to Kitagawa et al., describes electrolytic capacitors having terminals on one base face and a fixing frame at the other end, which are inserted in bags made of air-bubble plastic sheet of tubular shape. One end of the air-bubble bag is welded to form an end and a terminal protection part. The bags containing the electrolytic capacitor are compactly packed in a box of corrugated cardboard in alternating direction. Delicate terminals of the capacitors are safely and compactly packed within the air-bubble bag inside the box and the bent part of the fixing frames of the capacitor are safely isolated by the bag. (Abstract) FIG. 1*b* shows the bubbles on the interior of the bag contacting the surface of the capacitor protected by the bag.

U.S. Pat. No. 5,316,149, issued May 31, 1994 to Tate, discloses a reusable bag for packaging articles. The reusable bag is a perforated plastic bag filled with blown polystyrene beads of high compressive strength. A number of these bags are used within a box, surrounding a relatively heavy, but fragile article. When the lid of the box is closed, the closing action puts pressure onto the filled bags so that air contained in each bag is evacuated via the perforations in the bag. This forces the blown beads together to form a rigid structure molded generally to the shape of the article. When the box is opened and air returns to the bags, they once again become loose and flexible and can be reused. Again, the exterior surface of the bags is in contact with the article protected by the bags during shipment. More recently, non-perforated bags filled with air have been used to fill spaces around an article in shipping containers. The air bags maintain a constant pressure on the surface of the article in the shipping container, holding the article in position during shipping.

Japanese Patent No. 11189219 A, issued Jul. 13, 1999, describes packaging for shock absorption while transporting earthenware, glassware and precision machinery. The packaging includes an inner bag and an outer bag. After placing the article to be packed inside the inner bag and filling the space between the bags with a gas, the top and bottom of the inner and outer bags are each tightened with a clip so that the internal pressure between the bags increases to a specified value.

European Patent Application Number 00610071.3, published on Jan. 9, 2001 under publication number EP 1170225 A1, describes an "inflatable bag for packaging and protection and its method of producing". (Title) The basic description of the invention pertains to an inflatable bag produced from a single web of a foil material, where the web is folded into a four-ply assembly providing three chambers including an inner chamber sandwiched between two outer chambers communicating with one another through a passage delimited by the fold connecting the walls of the inner chamber together. The foil material may be a combination of a plastic material and aluminum foil. The second, inner chamber containing the object or product to be protected may constitute a single chamber having a configuration which is preferably the configuration or shape of the product. For maintaining the object or product in a specific orientation and position within the inner chamber of the bag, the second chamber is preferably further delimited by joints interconnecting the second and third foil layers, by way of example.

U.S. patent publication No. US2002/0064319 A1 of Tanaka et al., published May 30, 2002, describes a buffer packing bag which includes an air-supply passage which is made of plastic films placed one on another and bonded at desirable spots, with an air-inflatable section formed beside the air-supplying passage. The air-inflatable section is divided into individual air-inflatable parts, formed by heat bonding at multiple spots. Check valves allow and stop air flow between each of individual air-inflatable parts and the air-supplying passage. Space making folds, made in the divided portions of the air-inflatable section make at least two lines with a proper interval crossing each of the individual air-inflatable parts in order to contain an article in the buffer packing bag. A loading slit for the article is formed on the flat base of the bag by folding inward from both sides along the length side of the base and heat bonding both of the overlapped length sides of the base except for the area of an air inlet for the air-supplying passage. After an article has been loaded into the bag, air is pressured through the air inlet to the air-supplying package to send air to the individual air-inflatable parts of the buffer packing bag. The buffer packaging bag is better understood by looking at the illustrations. FIG. 3 shows an assembled bag with an article enclosed within the bag. The interior of the buffer bag is in contact with the article which is protected by the buffer bag.

A modified atmosphere package for high profile products from upwardly formed heat shrinkable film is described in U.S. Pat. No. 6,408,598 B1, issued Jun. 25, 2002. A packaging process is disclosed in which a high profile product is placed in a tray (extending above the tray). An upper film, including a sealant layer which is sealable to the tray, is positioned above the tray at a particular orientation. The entire assembly is present within a processing vessel which permits removing gases from the cavity between the film, the product, and the tray, while maintaining the film at its location above the tray. A desirable gas is introduced into the cavity and then the upper film, which has been heated, is allowed to shrink toward the product and the tray. The film shrinks down to hold the product against the tray, leaving space filled with the desirable gas between the lowermost portions of the product and the tray. The edges of the film are sealed to the edges of the tray. The modified atmosphere package is designed for packaging of a number of items which are sensitive to the environment, such as food items, for example, and particularly for meat.

As is apparent from reading the above descriptions, a package design is generally based on the end-use application for the package. Each application for a package has particular requirements if the product is to be protected and preserved by the package in which it is stored and transported. In the present instance, we are concerned about storage and transportation of articles which have a surface which is contact sensitive. In particular, the surface to be protected may be friable (easily broken or crumbled), may be chemically sensitive to contact by handling, or may be sensitive to exposure to a particular environment. In particular, we have developed packaging for semiconductor processing apparatus where at least one surface, and typically a plurality of surfaces are subject to damage by contact during storage prior to shipment, during transportation, and during storage prior to installation into the semiconductor processing environment.

It would be advantageous to have a package which restricts the motion of a surface-sensitive article within the package, which avoids contact of packaging materials with the surface-sensitive areas of the article during storage and shipment of the article, and which permits removal of the article from the package with minimal risk that the packaging will contact the surface-sensitive areas of the article during removal of the article from the package.

SUMMARY OF THE INVENTION

We have designed and developed flexible, semi-rigid, and rigid packaging which enables protection of surface-sensitive areas of an article from contact by the packaging during storage of the article in the package, shipment of the article in the package, and during removal of the article from the package. We refer to this packaging as "non-contact" packaging. The flexible non-contact packaging is typically used as interior packaging within an exterior packaging designed to accept heavier loading. This is a matter of economic practicality, however. It would be possible to construct an exterior wall of the non-contact packaging to withstand the rigors of shipping via commercial channels, at least with respect to the rigid non-contact packaging.

The non-contact packaging permits one using the packaging to ensure safe handling of the article, whereby surface-sensitive areas of the article are not harmed by the packaging.

The non-contact packaging typically comprises a rigid or semi-rigid base to which a non-sensitive surface of the article is attached, to hold the article in position within the package. The article is held to the base of the package using fasteners of the kind known in the art.

In one embodiment of the non-contact packaging, the majority of the package is comprised of a flexible material such as a polymeric film, which is sealed against the base of the package. Extending upward from the base of the package are support members which hold the flexible portion of the package away from sensitive surface areas of the article contained within the package. The support members may be flexible, semi-rigid, or rigid, and are designed to move the flexible portion of the package adjacent sensitive surface areas away from such sensitive surface areas of the article at a time when the package is opened, exposing the article for removal from the package without contact of the sensitive surface of the article during such removal.

In one embodiment of the flexible non-contact packaging, the flexible portion of the packaging is a polymeric film, to which a positive pressure is applied from the interior of the package. The positive pressure is created by a fluid present within the interior of the package. Typically the fluid is a gas. The composition of the fluid depends on the chemical properties of the surfaces of the article. For example, the fluid composition is typically non-reactive with surfaces of the article and is particularly non-reactive with sensitive surfaces of the article.

The flexible non-contact packaging comprises support members which may be flexible, semi-rigid, or rigid. The support members may be one of a number of shapes, or combinations of various shapes, such as arch shaped, fan shaped, fish bone shaped, and interleaved, by way of example and not by way of limitation. The important features of the support members are that they hold a flexible packaging exterior skin away from the sensitive surface of the article in the package and that they help move the packaging skin away from the sensitive surface of the article when the package is opened. The support members are attached to the package base or to a surface of the flexible exterior skin portion of the non-contact packaging which forms the exterior portion of the package. The support members may be attached to an inside surface or an outside surface of the flexible skin portion of the non-contact packaging. The support members are typically attached in an area adjacent a sensitive surface of an article positioned within the package so that the flexible exterior skin portion of the non-contact packaging is moved away from surface sensitive portions of the article when the packaging is opened.

In one embodiment, for example, flexible support members are tubular in shape and constructed of a polymeric film. The polymeric tubular support members are filled with a fluid, typically a gas. A portion of the flexible skin of the non-contact packaging rests upon the support members. In addition, in this embodiment, the interior volume of the non-contact packaging may be filled with a fluid also, typically a gas. When the package is opened and/or the positive pressure is removed from the interior of the flexible packaging, the tubular support members help to move the flexible skin away from the sensitive surface of the article in the package.

In another embodiment, for example, semirigid or rigid support members are attached to the base of the package in a hinged manner so that they fall away from the interior of the package when the package is opened, carrying the flexible exterior skin of the non-contact package away from the interior of the package.

Even when the exterior portion of the non-contact package is semirigid, the package may optionally be filled with a fluid to provide a positive interior pressure, to assist in maintaining a clearance between the non-contact package and a sensitive surface of an article contained within the package. When the exterior portion of the non-contact package is rigid, it is generally not necessary to pressurize the interior of the package, unless it is desired to prevent ambient atmosphere from entering the package. When the exterior portion of the non-contact package is semirigid, support members may not be necessary, depending on the application. However, the semirigid or rigid package is designed to open away from any sensitive surface of an article contained within the package. The opening provided must be adequate to enable removal of the article from the package without contact of a sensitive surface of the article by the package or by the person or tool used to remove the article from the package.

An internal environmental control fluid which is in contact with the sensitive surface of the article may be used in either the flexible or more rigid embodiments of the non-contact package, to ensure that the sensitive surface does not chemically react with a substance which is harmful to the performance of the sensitive surface in its end use application.

DETAILED DESCRIPTION OF EXEMPLARY EMBODIMENTS

As a preface to the detailed description, it should be noted that, as used in this specification and the appended claims, the singular forms "a", "an", and "the" include plural referents, unless the context clearly dictates otherwise.

Disclosed herein is a non-contact package which is useful when an article to be stored or shipped in the package includes a sensitive surface, the performance of which will be detrimentally affected if the sensitive surface is contacted with a nominal amount of mechanical force. In some instances, a fluid may be used interior to the non-contact package, which fluid does not detrimentally affect the article's sensitive surface, to prevent an undesirable chemical reaction on the sensitive surface. In some instances, a fluid environment is used inside the package to support a flexible exterior skin (exterior walls) of the package, so that the exterior walls of the package do not contact the sensitive surface and/or to dissipate force applied to the exterior of the package, so that the sensitive surface will not be damaged. The exterior of the package may be abraded without damage to the sensitive surface of the article. In selecting of the materials of construction to be used for the non-contact package, one skilled in the art will need to take into account the exterior environmental conditions to which the package will be exposed.

The non-contact package may consist essentially of rigid packaging components, may include rigid and/or semi-rigid components in combination, or may include rigid, and/or semi rigid components in combination with flexible components.

The more advantageous embodiments of the non-contact packaging not only protect sensitive surfaces of articles within the packaging during storage and shipping of the package, but also reduce the possibility that sensitive surfaces of the article will be damaged by contact with the packaging material during removal of the article from the package.

When the non-contact package includes flexible components, the non-contact package may be placed within more rigid packaging during storage and shipment.

The Figures which are provided as a part of the present disclosure are intended to illustrate the concepts of the invention, but are not intended to be limiting, as one skilled in the art having read the present disclosure will be able to devise additional embodiments which will operate in a similar manner to accomplish the same purpose.

Figure 1A:
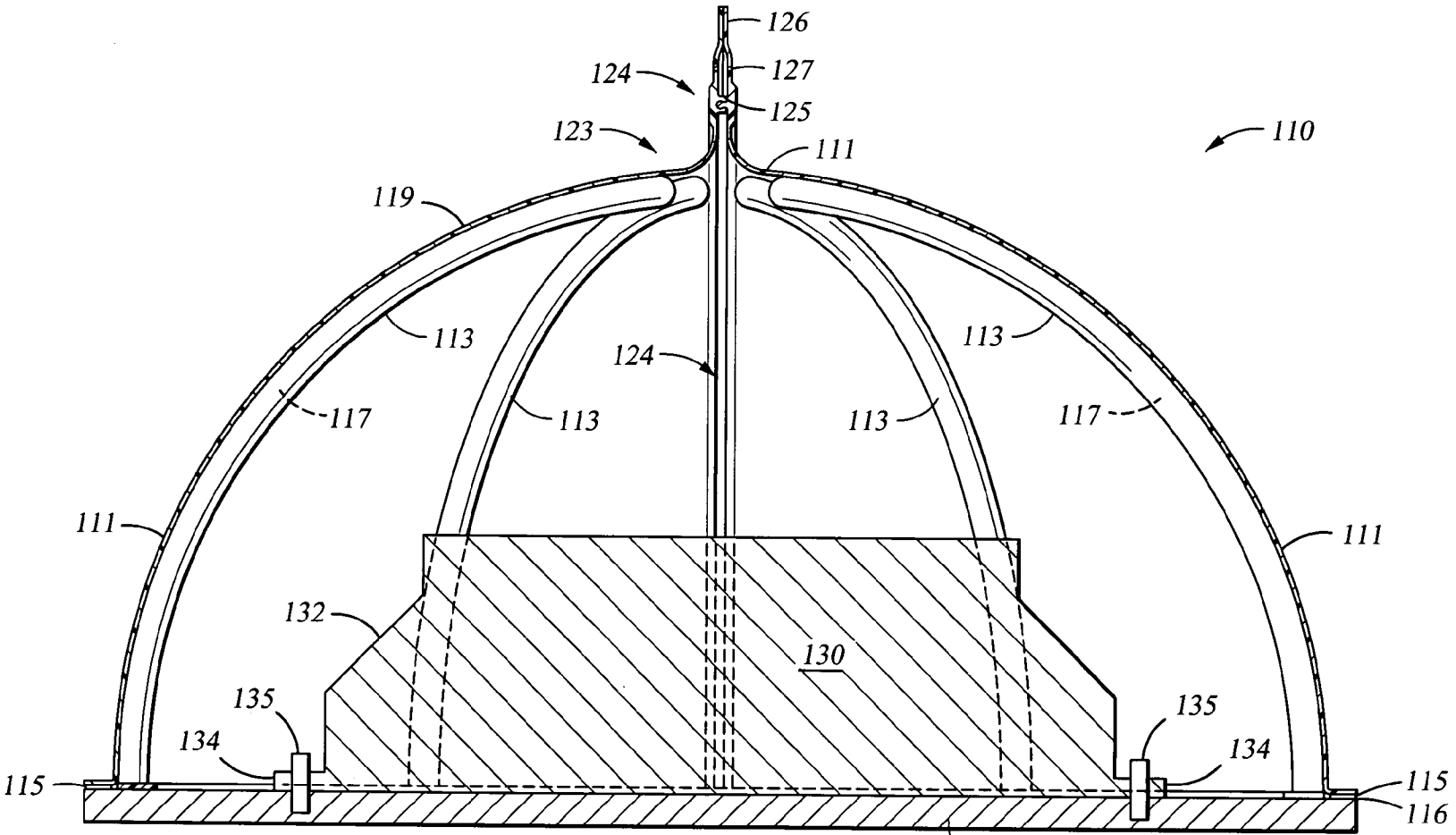
FIG. 1A illustrates a cross-sectional schematic view (not to scale) of one flexible embodiment of the non-contact package 110. The article 130 enclosed in the non-contact package 110 is attached to a base 112 at a non-sensitive surface 134 of the article 130. Tubular support members 113 filled with a fluid 117 are used to maintain the flexible exterior skin (layer/portion) 111 of the non-contact package 110 away from sensitive surface 132 of an article 130.

FIG. 1A illustrates a cross-sectional schematic view of a flexible embodiment of a non-contact package 110. The non-contact package 110 includes a rigid or semi-rigid base 112 which is in contact with a non-sensitive (flange) surface 134 of article 130. A fastener 135 is used to hold article 130 in a desired position with respect to the base 112. Tubular support members 113 filled with a fluid 117 are used to maintain the flexible exterior skin (layer/portion) 111 of the non-contact package 110 away from a sensitive surface 132 of an article 130. The flexible exterior skin 111 is sealed against base 112 by a sealing bead 115 (which may be an adhesive seal or a heat seal, for example and not by way of limitation) around the exterior edge 116 of base 112.

A rigid base is one which will not deform under conditions anticipated to occur during handling shipment and storage of the package. The base is firm rather than pliant, and is generally impact-resistant so that it will not fracture or crack under normal conditions of handling. Rigid materials which may be used as a base include metals, plastics, reinforced plastics, and laminates, by way of example and not by way of limitation. The rigid base material may be conformed to fit the article to be packaged, if desired. A semi-rigid base is one which may deform under some conditions, but which is also firm and impact-resistant. When deformation does occur, the deformation is designed to avoid the contact of sensitive surfaces 132 of article 130 with packaging material. Semi-rigid materials which may be used as a base include plastics, reinforced plastics, and laminates, by way of example and not by way of limitation. Semi-rigid materials may be reinforced by rigid materials to provide stability for the package base 112.

The attachment of a non-sensitive surface 134, such as the flange, of article 130 to base 112 may be any kind of attachment known in the packaging art, and will depend on the weight and size of the article 130. In FIG. 1A, article 130 is shown as being held in place by fasteners 135, a plurality of which are used to constrain the article 130 in the relative center of the non-contact package 110. The article illustrated in FIG. 1A is cylindrical, and the package 110 may be cylindrical, rectangular, or conformal to but spaced away from the article 130.

As previously discussed, the sensitive surfaces 132 of the article 130 must be protected from contact with packaging material which makes up flexible exterior skin 111 of non-contact package 110. In the embodiment shown in FIG. 1A, the flexible exterior skin 111 of non-contact package 110 is a polymeric film material 119, which may be transparent or may be colored for purposes of protecting article 130 from radiation, or colored for purposes of part (article) identification, for example and not by way of limitation. Polymeric film material 119 is flexible and may or may not exhibit sufficient rigidity to support its own weight. Flexible materials such as polyethylene, polypropylene, polyimide, polyamide, polyacrylonitrile, polyester, polyurethanes, aramids, and cellulose may be used, by way of example and not by way of limitation. In instances where the flexible material will sag without the use of support structures, it is necessary to provide such support structures, which may be used in combination with internal package pressurization. If the polymeric film material 119 or other similar flexible material, such as a metal foil or paper with a foil laminated to the paper (for example and not by way of limitation) is sufficiently rigid that it will not sag upon opening of the package 110, sufficiently tough and impermeable that it will not lose pressure on storage and handling, and can be stripped away with minimal possibility of contact with sensitive surfaces 132 of article 130, it may be adequate to internally pressurize the flexible exterior skin 111 of package 110 with a fluid, typically a gas such as air or nitrogen. This pressurization will reduce the possibility that flexible exterior skin of package 110 will contact sensitive surface 132 during handling of the packaged article, during shipment of the package, or during storage prior to opening. The sealing system used to seal the exterior skin 111 to the base 112 may be used as part of a gas-tight seal, for example. In FIG. 1A, the sealing system is a tacky sealing layer 115 around the exterior edge 116 of base 112, which adheres flexible exterior skin 111 to the surface of base 112. The sealing layer 115 prevents particles from entering the interior of package 110 and can be used to produce a gas-tight seal, in combination with a sealing package closure device, for example.

Support members 113 may be formed from a springy plastic material which pushes against flexible material of the exterior skin 111 of package 110 to hold the flexible material away from sensitive surfaces 132. The support structures 113 may be formed using metal reinforcements (not shown) encased in plastic or bonded to the outside of plastic support structures, for example, to apply a force to the flexible exterior skin 111, to hold the flexible skin 111 away from the article 130. The support members 113 may be positioned interior of the exterior skin 111 of non-contact package 110 as shown in FIG. 1A, or may be attached to the exterior surface (not shown) of the exterior skin 111 of non-contact package 110.

Figure 1B:
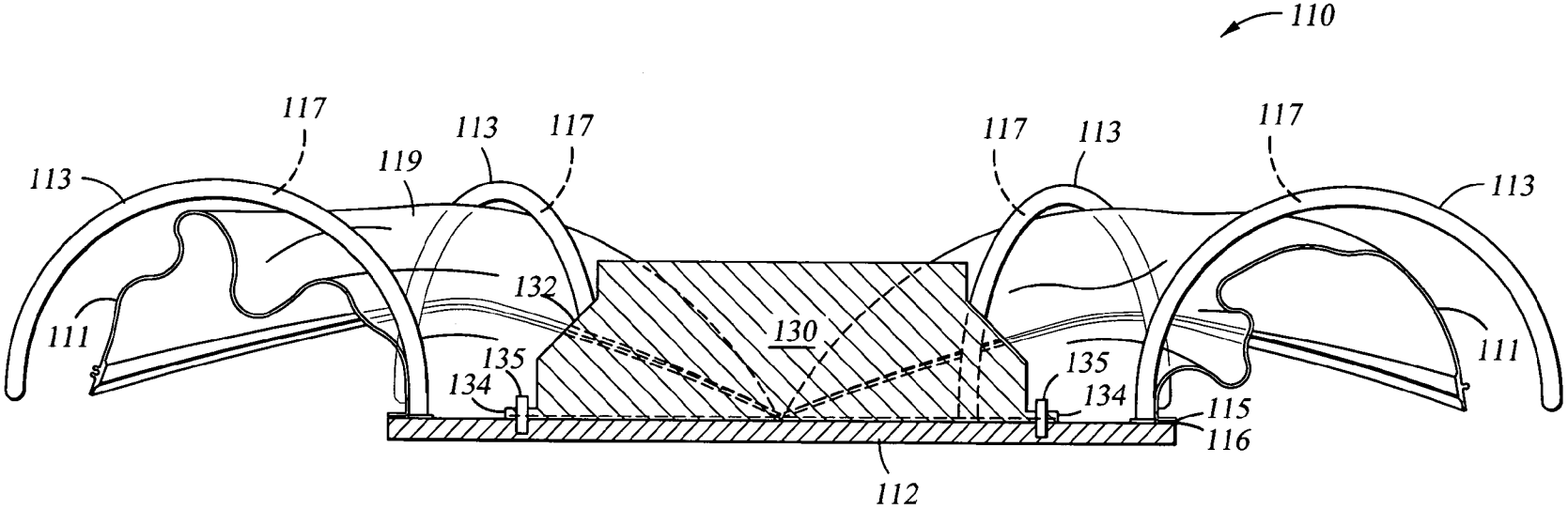
FIG. 1B shows the flexible non-contact package 110 of FIG. 1A after the non-contact package 110 has been opened, illustrating how the support members 113 move the flexible exterior layer 111 of the non-contact package 110 away from sensitive surface 132 of article 130 upon opening of the non-contact package 110.

FIG. 1B shows the flexible non-contact package 110 of FIG. 1A after the non-contact package 110 has been opened, illustrating how the support members 113 move the flexible exterior skin 111 of the non-contact package 110 away from sensitive surface 132 of article 130 upon opening of the non-contact package 110.

Figure 2:
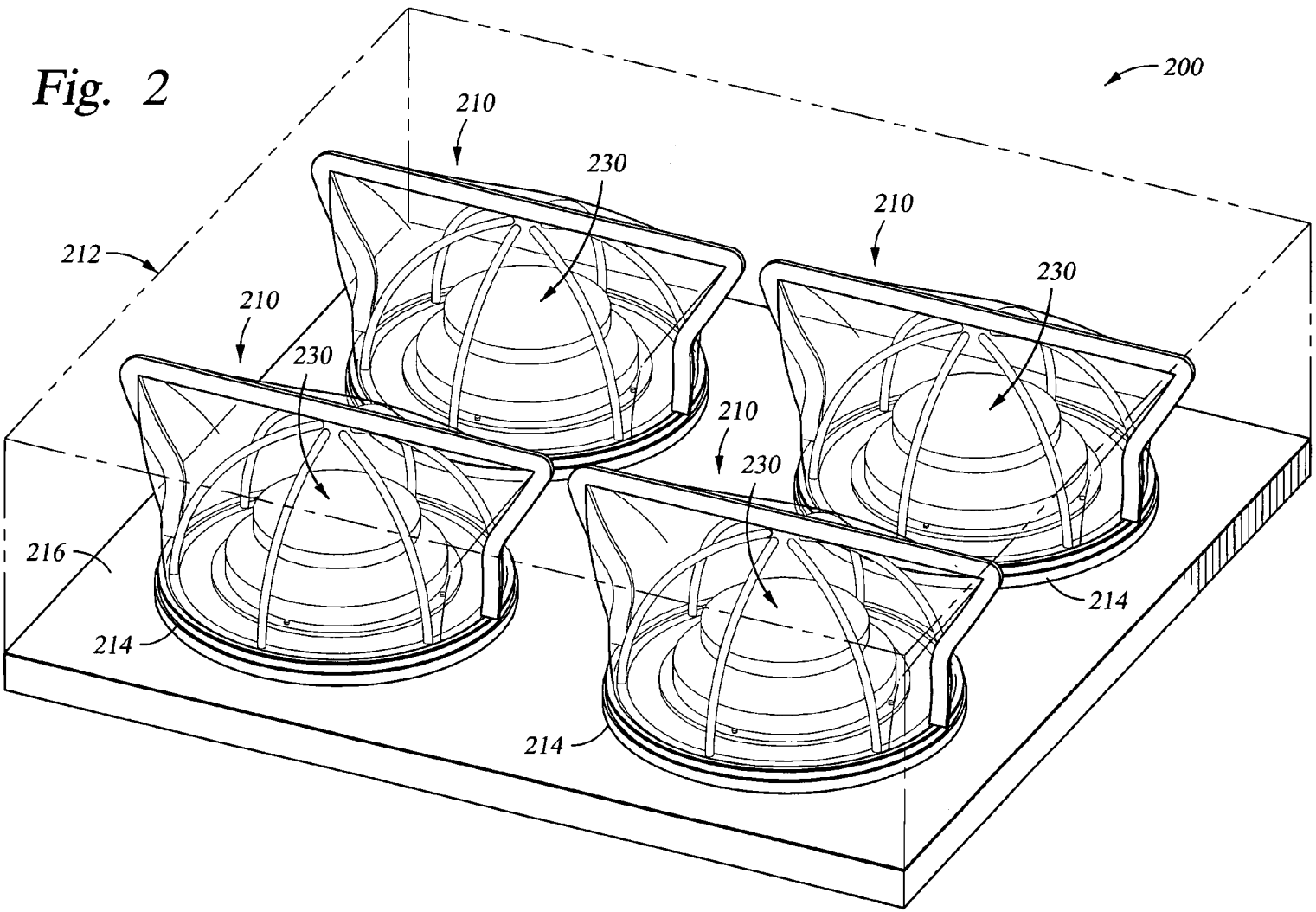
FIG. 2 shows a schematic (not to scale) view of a plurality of flexible non-contact packages 210 fixed in position within a rigid shipping container 212.

FIG. 2 illustrates a side view, cross-sectional schematic of an assembly 200 including a flexible embodiment of a non-contact package 210 similar to the embodiment 110 shown in FIG. 1A, where a plurality of the flexible non-contact packages 210 are placed within a rigid shipping container 212. The flexible non-contact packages 210 may be held in position within shipping container 212 in a number of manners which are known in the art. The bottom surface 216 of rigid shipping container 212 may have formations (not shown) into which base 214 of non-contact package 210 may be inserted, interlocked, or attached. The rigid shipping container 212 protects the flexible non-contact packages 210 during transit and may be used for storage prior to opening of the non-contact packages 210. The flexible non-contact package 210 protects the sensitive surfaces of the packaged article 230 from coming in contact with the rigid exterior packaging 212. The flexible non-contact package 210 also protects the sensitive surfaces of the packaged article 230 during unloading of the flexible non-contact package from the rigid container to a safer area in which the flexible packaging can be opened in a manner which protects the sensitive surfaces of the article 230. The rigid shipping container 212 may be sized to contain a single non-contact package 210 as well.

Figure 3:
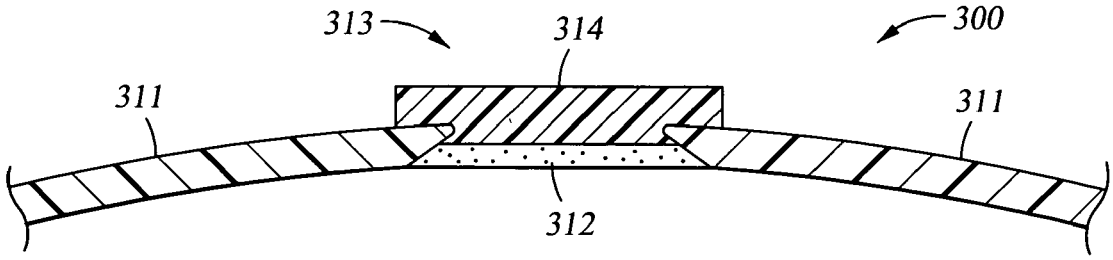
FIG. 3 illustrates a side view, cross-sectional schematic (not to scale) of an upper portion 311 of a flexible non-contact package 300, showing one opening mechanism 313 which includes a heat seal layer 312 and a pull tab 314.
Figure 4:
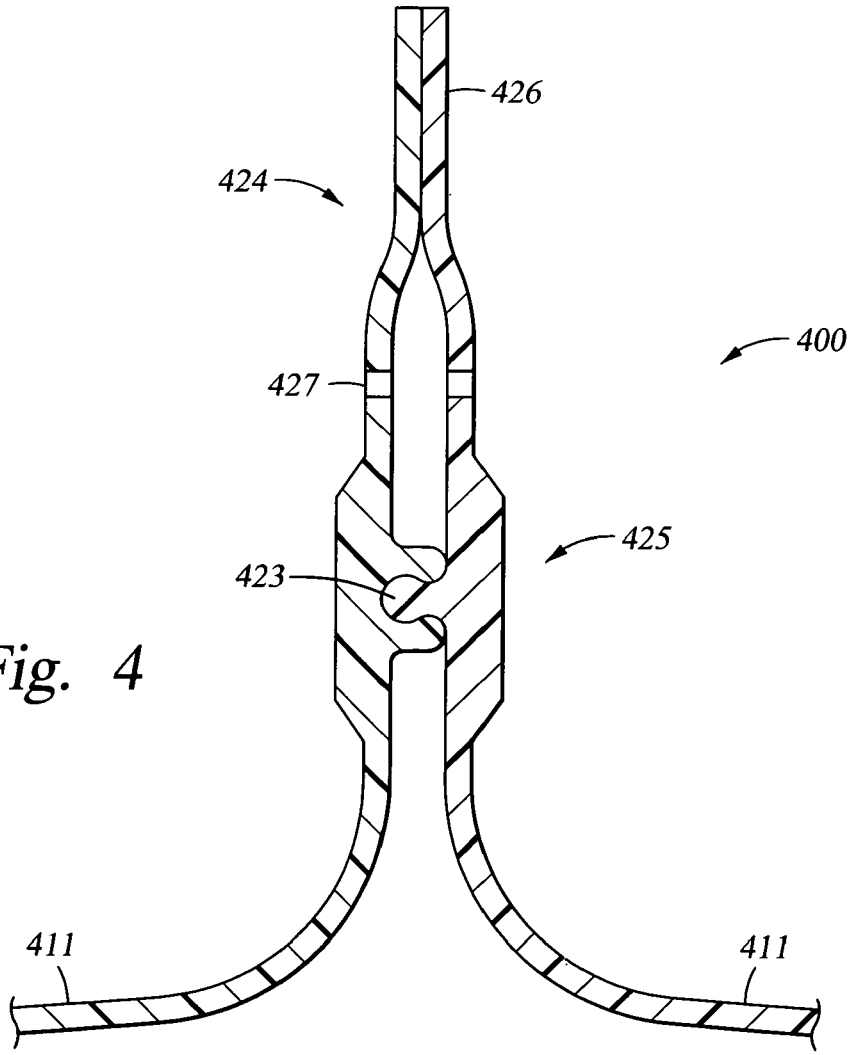
FIG. 4 illustrates a side view, cross-sectional schematic (not to scale) of an upper portion 411 of a flexible non-contact package 400, showing an alternate opening mechanism 424 which includes a zip lock/zip seal 423, a tear line 427, and a heat sealed area 426.

There are a variety of manners known in the art of package closure which may be used for opening and closing the non-contact package. With reference to FIG. 1A, a zip lock closure 124 is shown, which includes interlocking protrusions 125, a heat sealed upper area 126 and a tear open section 127 between the interlocking protrusions 125 and the heat sealed area 126. In some instances, where a gas tight-seal is not necessary, for example, particular areas of the upper portion 123 of flexible exterior skin 111 of non-contact package 110 may have weakened areas which can be pushed upon or slit in a manner so that the flexible skin 111 folds back in a manner similar to that shown in FIG. 1B upon opening of the package. Detailed example embodiments of two closure devices which are useful for producing a gas-tight sealed flexible non-contact package are illustrated in FIGS. 3 and 4.

The opening mechanisms used in the flexible exterior skin 111 will, in most cases, be used as one time opening devices.

Typically the flexible exterior skin will be in the form of a polymeric film which is bought with the opening mechanism already attached or molded in, for example a zipper lock or a rip strip. This area of the flexible exterior skin typically will not be used as a closure point during the packaging of a part. In general, the part to be protected will be mounted to the base. Then the exterior skin (flexible covering), with rigid or semi-rigid supports and opening mechanism already attached will be lowered over the part and bonded onto the base, with either an adhesive or heat seal.

In the case of a zipper lock style of opening, it will be possible to reload a sued part into the packaging enclosure for shipment back to a refurbishment or disposal facility. This package reclosure will not be as secure as the original package closure.

FIG. 3 illustrates a schematic cross-sectional view of an assembly 300, which includes a pull-tab or rip strip type opening mechanism 313 which may be part of the exterior skin 311 of a flexible non-contact package (not shown). This opening mechanism 313 is created by bonding of a plastic ribbon 314 onto the flexible fabric film 311 in the location where the cover is designed to be opened. This ribbon can be bonded to the film by either an adhesive or heat bond 312. The pull strip 314 may traverse any nominal desirable length of the exterior skin of the flexible non-contact package, but must enable movement of the flexible exterior skin 111 of the non-contact package away from the sensitive surfaces of the article within the non-contact package upon opening of the package, and must provide for easy removal of the article from the package without contact of the sensitive surfaces of the article. The closure shown in FIG. 3 is not reclosable.

FIG. 4 illustrates a schematic cross-sectional view of an assembly 400 which includes a compound closure 424, which includes a heat sealed second level closure 426, a tear open section 427, and a first level interlocking closure 425 which acts to close the flexible exterior skin 411 of a non-contact package (not shown). This compound closure 424 can be reused after opening of the non-contact package, although the second level heat sealed closure will have been removed during the opening procedure. The interlocking closure 425, includes interlocking protrusions 423 which may provide a gas-tight seal, or may include interlocking protrusions which simply provide a fastening action which closes the non-contact package. When the interlocking closure 425 does not provide a gas-tight seal, then the non-contact package will lack this feature after it has been opened once. The tear open section 427 is a weaker area of the compound closure 424, which can be grabbed and torn away from compound closure 425 to expose interlocking closure 425, subsequently portions of the interlocking protrusions 425 are pulled apart to open the non-contact package.

One skilled in the art will recognize that the examples shown in FIGS. 3 and 4 are just a few of the possibilities for closures which may be used by the flexible non-contact package. We are providing these examples by way of illustration and not by way of limitation.

Figure 5A:
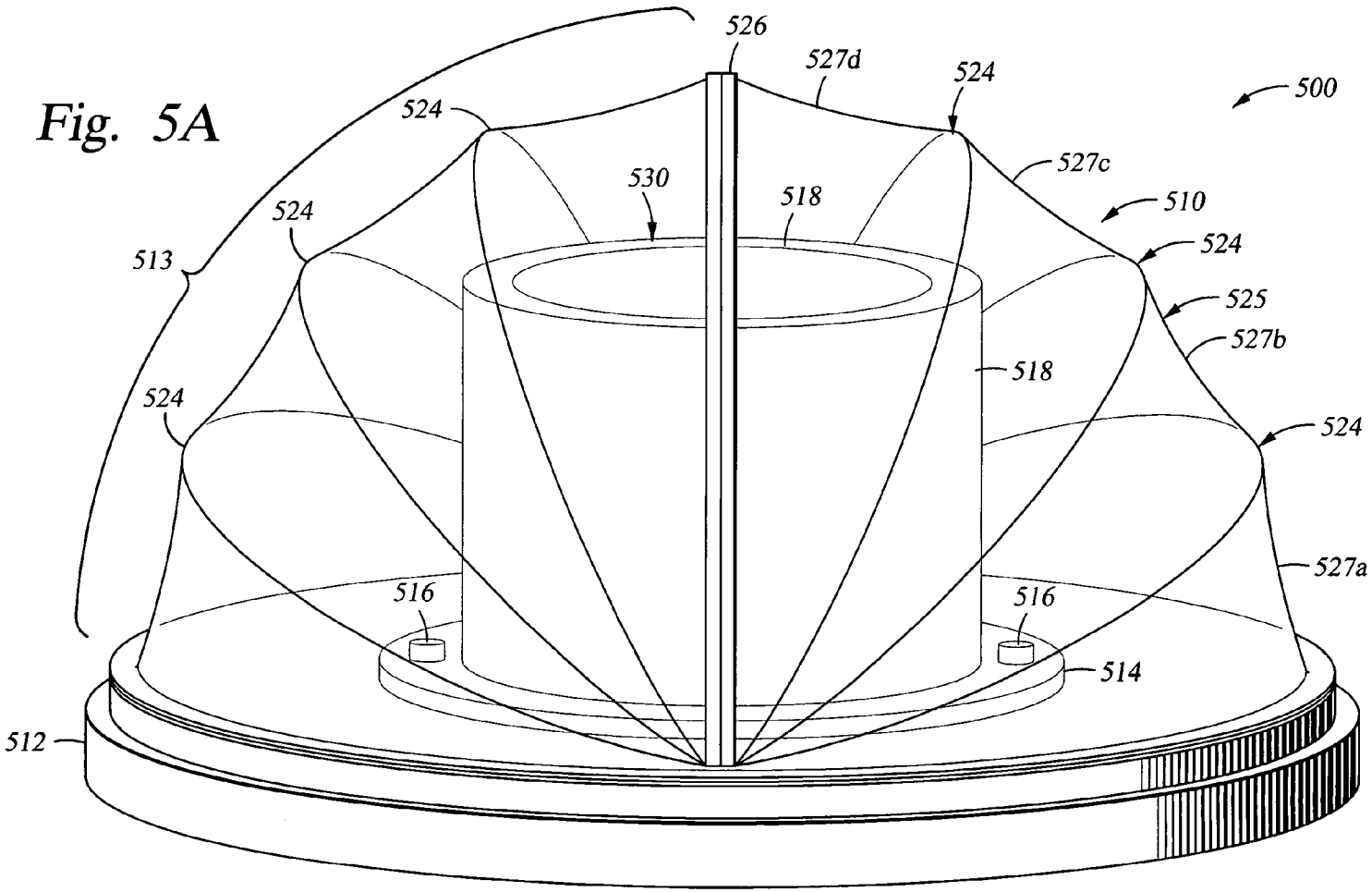
FIG. 5A shows a side-view, semi-three dimensional schematic (not to scale) of another assembly 500 including a flexible non-contact package 510 with an enclosed article 530. The article 530 enclosed in the non contact package 510 is attached to a base 512 at a non-sensitive surface 514 of article 530. Movable rigid support members 524, covered by a flexible film layer 525, provide an exterior surface 513 which is fastened/sealed along an opening interface 526.
Figure 5B:
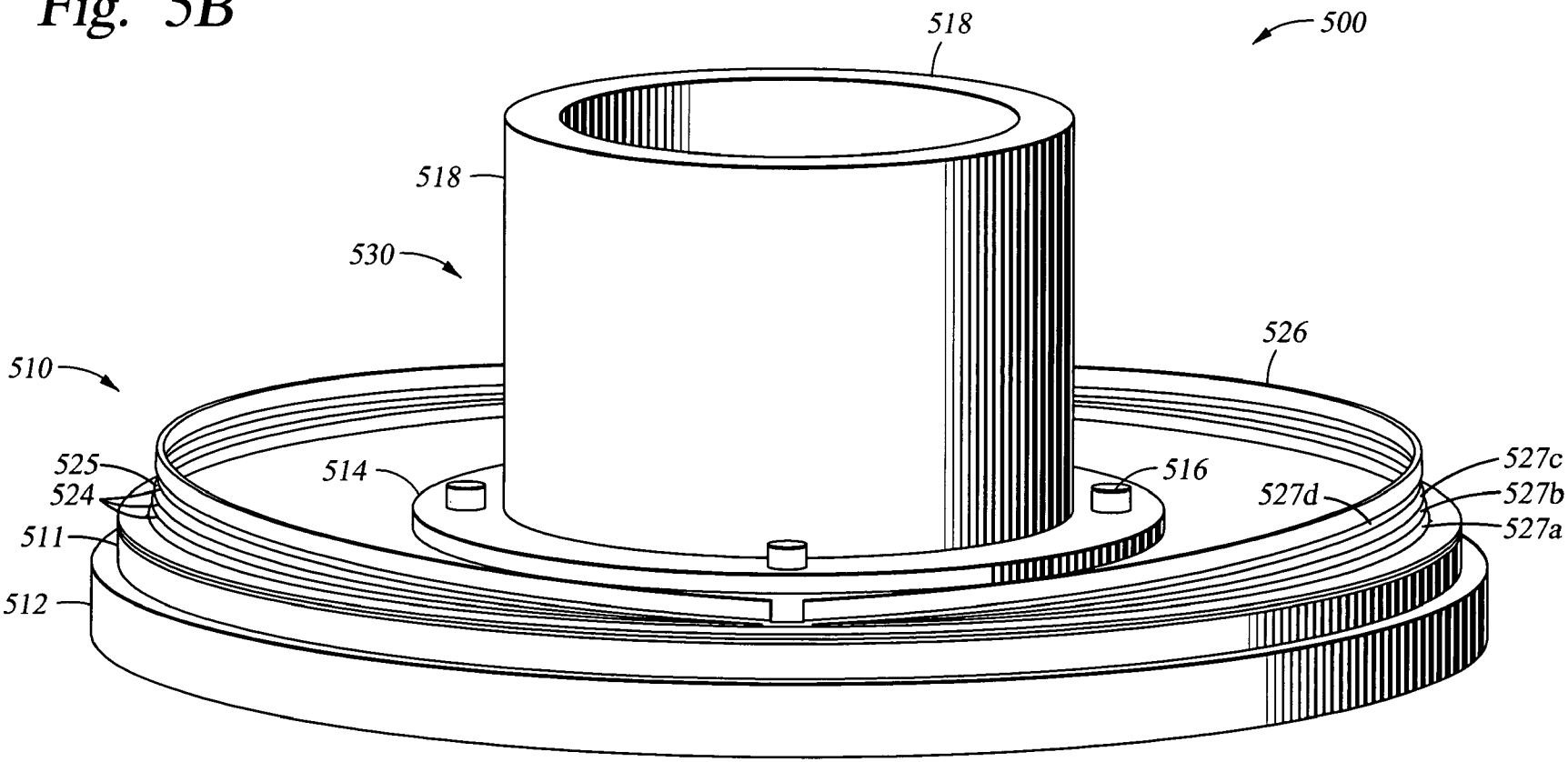
FIG. 5B shows the flexible non-contact package 510 of FIG. 5A after it has been opened at opening interface 526, followed by movement of movable rigid members 524 so that they collect upon an upper surface 511 of base 512, to expose article 530, without contacting sensitive surface 518 of the article 530.

FIGS. 5A and 5B illustrate another embodiment of a non-contact package which is a flexible non-contact package. With reference to FIG. 5A, assembly 500 illustrates a flexible version of a non-contact package 510, where the outer skin 525 of non-contact package 510 is a flexible material such as a polymeric film, which is supported by supporting members 524 which are movable, to provide a folding web 513 which can be drawn upward from a base 512 toward a closure 526, to close the non-contact package 510. The supporting members 524 may be wires or may be constructed from other rigid or semi-rigid materials which can be shaped as desired. The non-contact package 510 can then be opened by opening the closure 526, which is typically an interlocking closure, and folding back folding web 513, so that it lies upon base 512 in the manner shown in FIG. 5B, to expose article 530 without touching sensitive surfaces 518 of article 530. Typically, article 530 is held in place by attaching a non-sensitive surface 514 of article 530 to base 512 using a fastener 516.

A design similar to that shown FIG. 5A can be used to provide a semi-rigid non-contact package. The semi-rigid non-contact package includes a rigid base 512 and a plurality of semi-rigid, shaped exterior shell components 527*a*–527*d* which make up the exterior package surface 513. Exterior shell components 527*a*–527*d* slide over one another both during initial closing of the non-contact package 510 (shown in closed position in FIG. 5A) and during opening of the package (shown in open position in FIG. 5B). When the non-contact package 510 is in the open position as shown in FIG. 5B, the outer shell components 527*a* through 527*d* are stacked upon each other upon an upper surface 511 of base 512 of package 510, away from the sensitive surface 518 of article 530. The manner in which the rigid non-contact package 510 opens provides for easy removal of the article 530 without contact of the sensitive surface 518. The closure 526 which is used is designed to handle the weight of the shaped, semi-rigid outer shell components, and may be a closure of the kind known in the art, so long as the closure does not generate particulates or other environmental substances which would affect the sensitive surface 518 of article 530.

Figure 6:
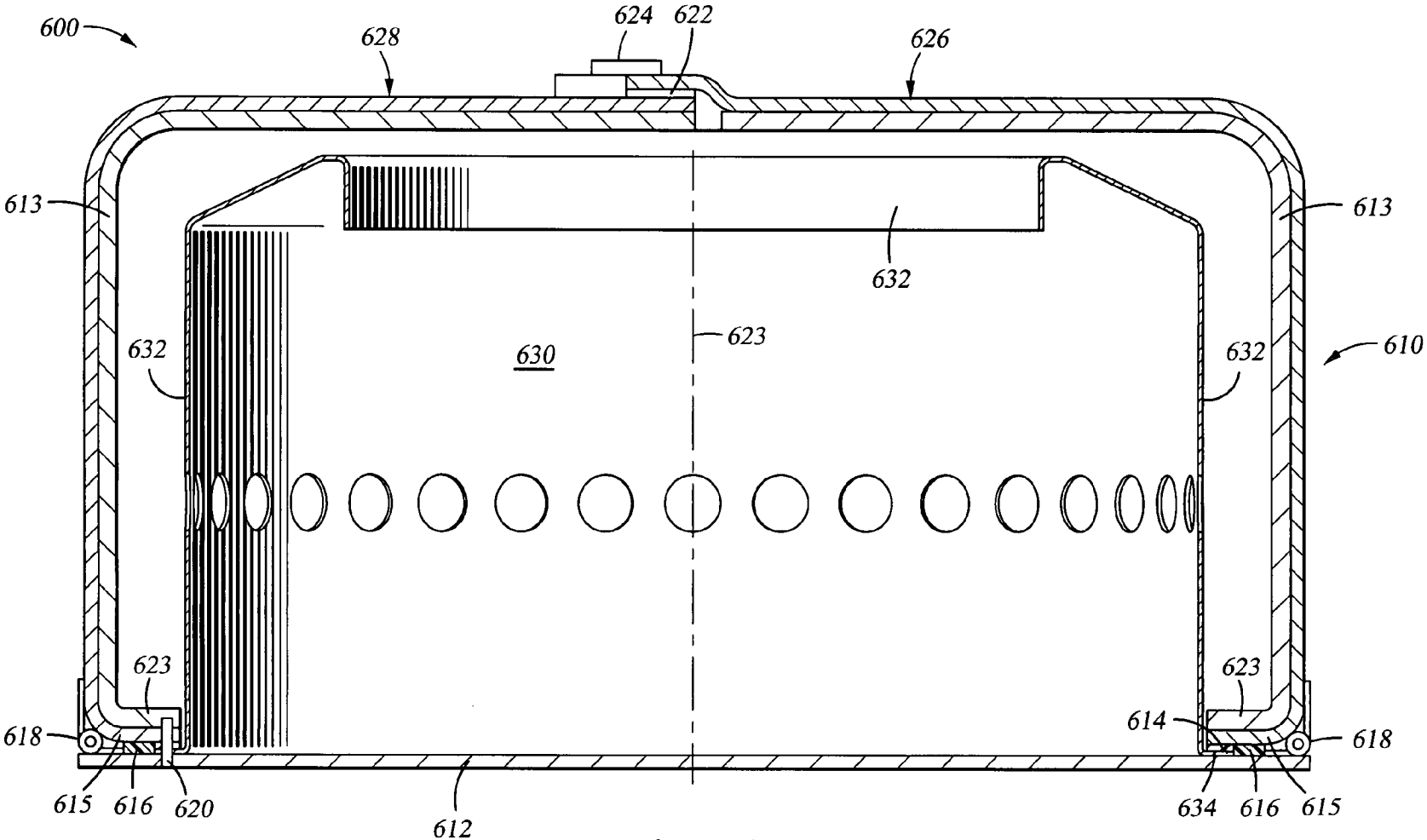
FIG. 6 illustrates a side view, cross-sectional schematic of an assembly 600 including a semi-rigid embodiment of the non-contact package 610. The article 630 enclosed in the non-contact package 610 is held down to a base 612 at a non-sensitive surface 634 of article 630 by a clamping action produced by a force applied by a plurality support members 613, which force is transferred through exterior wall 611 into retention block 614. Support members 613 may be made from a springy, semi-rigid material or from a rigid material, are used to help support a semi-rigid, shaped exterior wall 611 of the package 610.

FIG. 6 shows a side view cross-sectional schematic of a an assembly 600 including a semi-rigid non-contact package 610 with an enclosed article 630. The article 630 enclosed in the non-contact package 610 is positioned relative to a packaging base 612 by a plurality of locator pins 620, and is held against base 612 by a clamping action at a non-sensitive surface on a bottom flange 634. The force applied to generate the clamping action is applied by the base flange 615 of the semi-rigid shell 611 pressing on foam retention blocks 614 which are in contact with article bottom flange 634. In detail, there are a plurality support members 613, the extremities 623 of which are in contact with the base flange 615 of exterior wall 611 which transfers a loading into retention block 614. Support members 613, may be made from a springy, semi-rigid material or from a rigid material, and are used to help support a semi-rigid, shaped exterior wall 611 of the package 610. The exterior wall 611 of semi-rigid non-contact package 610 may be fabricated from thicker flexible polymeric film ranging from about 0.01 inches to about 0.02 inches in thickness, from a blow-molded plastic, or from a thin thermoformed plastic, by way of example and not by way of limitation. A compressible seal 616, which is present around the perimeter of non-contact package 610, helps prevent contaminants from entering semi-rigid non-contact package 610. The semi-rigid non-contact package 610 also includes support structures 613 which are used to maintain a distance between exterior wall 611 (which is formed from a flexible or semi-rigid material) and sensitive surfaces 632 of article 630. The support structures 613 may be a plurality of metal, or plastic, or reinforced plastic rods, for example, which are present at a number of locations around the package. The closure for semi-rigid non-contact package 610 is typically a latch 624 which includes a seal 622, typically a foam seal, where seal 622 travels the entire length of the contact surfaces which act as a closure along a center line 623 of semi-rigid non-contact package 610. When latch 624 is opened, permitting the two halves 626 and 628 of the exterior wall 611 of rigid non-contact package 610 to separate, each half, 626 and 628 can be opened against a hinge 618, so that each half opens away from sensitive surfaces 632 on article 630 as the center of gravity for that half of exterior wall 611 shifts away from the centerline 623. This feature will be described in more detail with reference to FIGS. 7A and 7B which follow.

Figure 7A:
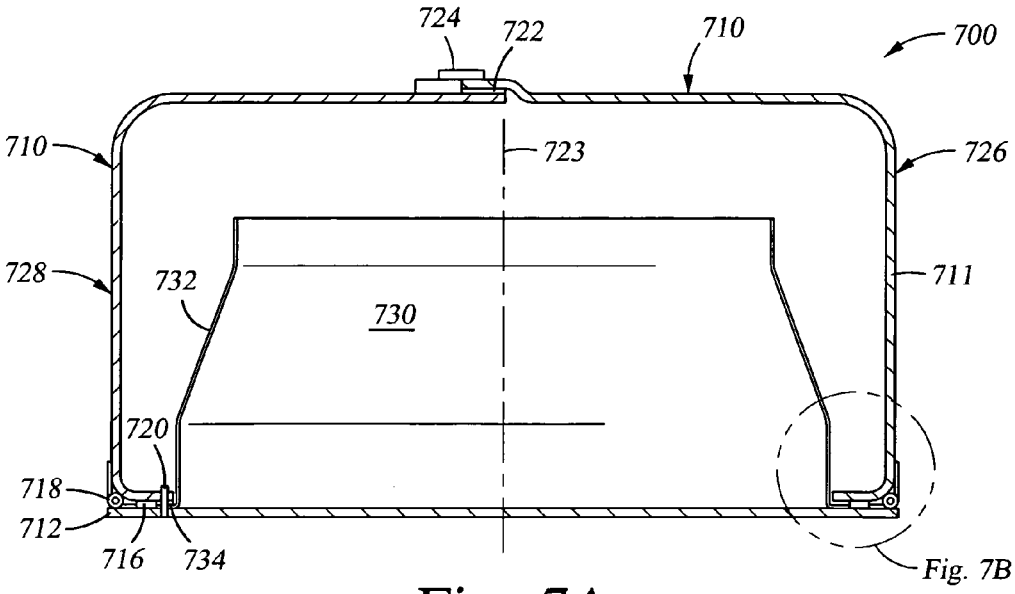
FIG. 7A shows a side view, cross-sectional schematic of another assembly 700 including a rigid embodiment of a non-contact package 710. The article 730 enclosed in the non-contact package 710 is held down to a base 712 at a non-sensitive surface (a flange) 734 of article 730 by compression contact with a retention block 714 which is adhered to a hinge 718 element.
Figure 7B:
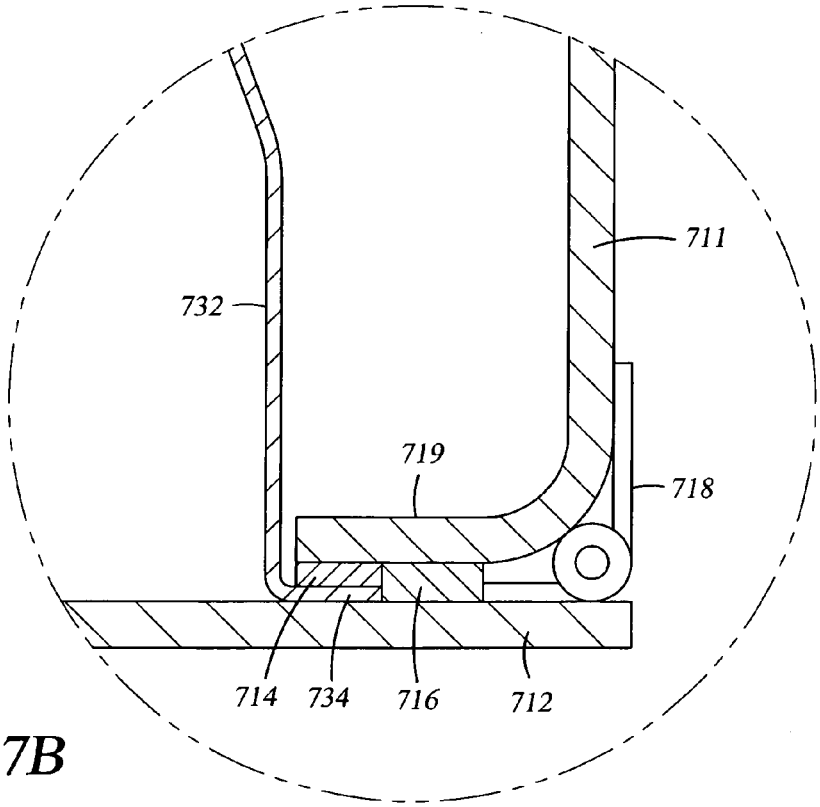
FIG. 7B shows an enlargement of the hinge area of FIG. 7A.
Figure 7C:
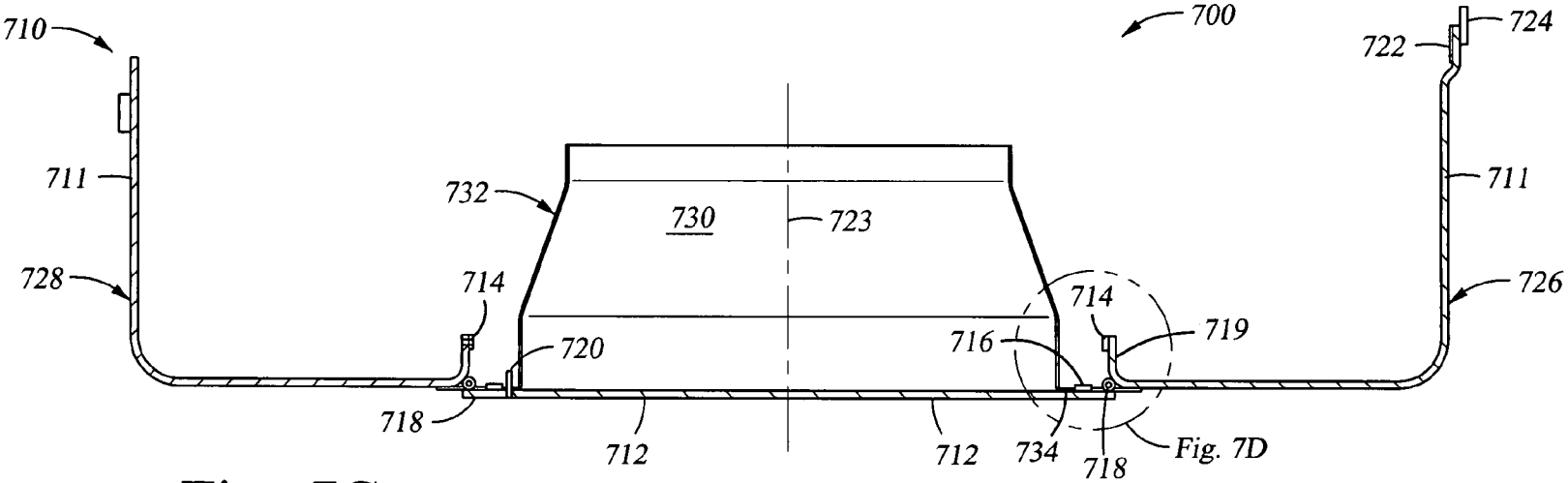
FIG. 7C shows a side view, cross-sectional schematic of the assembly 700 of FIG. 7A, where the non-contact package 710 is opened, to expose the article 730.

FIGS. 7A and 7C are schematic cross-sectional views of an assembly 700 which includes a rigid non-contact package 710 and an article 730 having sensitive surfaces 732. In FIG. 7A, the non-contact package 710 includes a rigid base 712 and a rigid exterior housing 711. The article 730 is fixed in position against rigid base 712 by clamping the non-sensitive surface (flange) 734 of article 730 to rigid base 712 using a pressure generated by the pivoted flange 719 of exterior housing 711 upon a retention block 714 which is in contact with flange 734, in the manner which was described with respect to FIG. 6. The article 730 is shown clamped to rigid base 712 in FIG. 7A, with an enlargement of the hinge area including pivoted flange 719 shown in FIG. 7B. Location pins 720 help maintain article 730 in a desired position upon base 712.

Figure 7D:
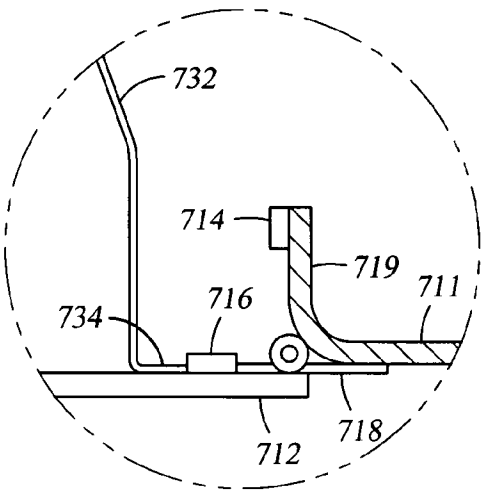
FIG. 7D shows an enlargement of the hinge area of FIG. 7C.

The exterior housing 711 of rigid non-contact package 710 is typically fabricated from a rigid molded plastic, by way of example. There is no need for support structures, since the housing 711 itself is rigid. In addition to the retention block 714, which may be a continuous formation around the periphery of the housing 711 or may be a plurality of individual spaced blocks, a compressible seal 716, is present around the entire perimeter of rigid non-contact package 710. The closure for rigid non-contact package 710 is typically a latch 724 which includes a seal 722, typically a foam seal, where seal 722 typically travels the entire length of the contact surfaces which act as a closure along a center line 723 of rigid non-contact package 710. When latch 724 is opened, the two halves 726 and 728 of the exterior wall 711 can be separated in a clam-shell fashion as illustrated in FIG. 7C. Each half is opened against a hinge 718. As shown in this embodiment, the retention block (or plurality of blocks) 714 release flange 734 of part 730 when the hinge 718 is opened. An enlargement of the hinged area is shown in FIG. 7D. The weight of each half of the housing, 726 and 728 helps open the housing away from article 730 once separation of the housing halves is begun and the center of gravity of the half moves away from the centerline 723 of non-contact package 710.

Figure 8A:
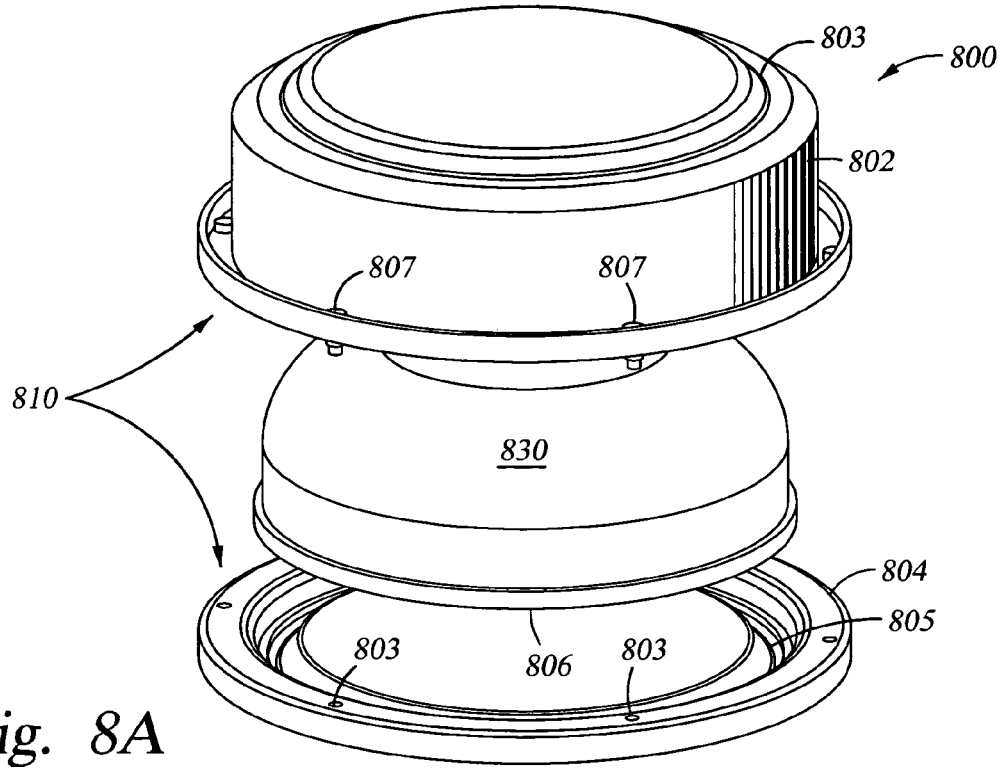
FIG. 8A illustrates an expanded view schematic of an assembly 800 which includes a rigid non-contact package 810 including an upper hard cover 802, and a rigid base 803, with an example article, a bell jar, 830 inside.
Figure 8B:
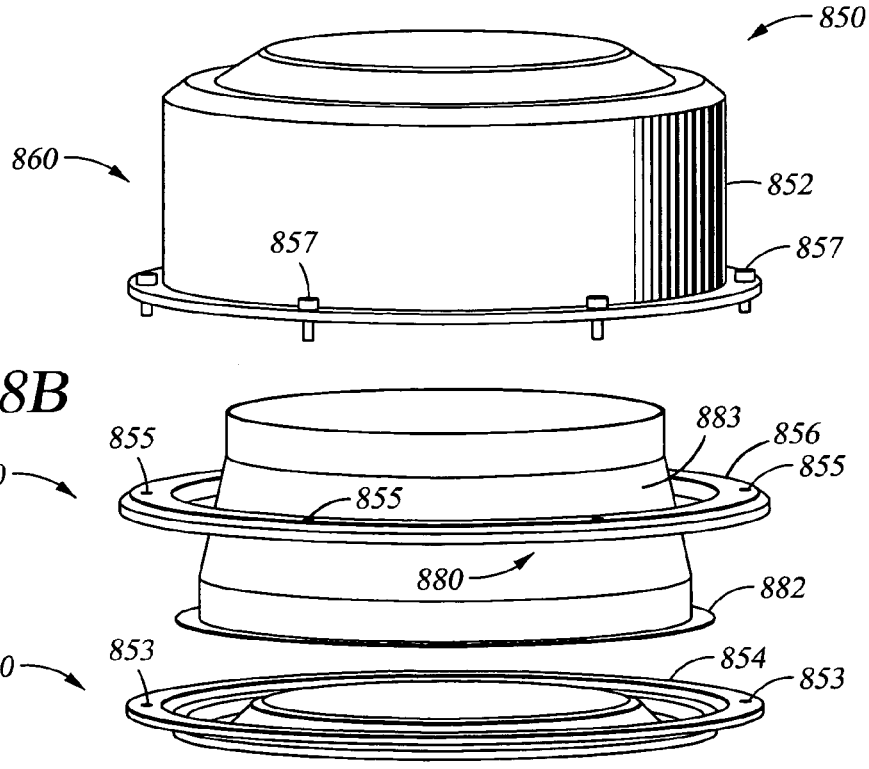
FIG. 8B illustrates an expanded view schematic of an assembly 850 which includes a rigid non-contact package 860 including an upper hard cover 852, a rigid base 854, and a retainer ring 856 which acts against a non-sensitive surface of a flange 882 to hold article 880 in place within the non-contact package 860.

FIGS. 8A and 8B illustrate additional embodiments of a rigid non-contact package. With respect to FIG. 8A, an assembly 800 is illustrated in a schematic break away view. The assembly 800 includes a rigid non-contact package 810 enclosing an article (a bell jar, for example) which has an interior surface (not shown) which is a sensitive surface. The non-contact package 810 includes an upper housing 802 and a base 804. These components of non-contact package 810 are typically produced from a molded plastic or a thermoformed plastic, where the plastic may be a reinforced plastic. The upper housing 802 is typically molded to include ridged structures 803 which provide additional mechanical strength and which may be stacked for ease in storage and shipment. The base 804 includes depressions 805, into which the base 806 of bell jar 830 fits. In the illustrated embodiment, the upper housing 802 and base 804 are fastened together using fasteners 807 which pass into or through apertures 803 in base 804. However, one skilled in the art will understand that other fastening devices such as locking clamps and closures may be used.

FIG. 8B shows a schematic break-away view of an assembly 850, including another embodiment of a rigid non-contact package 860 which is similar to the rigid non-contact package 810 shown in FIG. 8A. In FIG. 8B, in addition to upper housing 852 and base 854, there is a retaining ring 856 which acts against a non-sensitive surface, flange 882 at the bottom of article 880, to hold article 880 in place within non-contact package 860. Since it is the exterior surface 883 of article 880 which is sensitive, it is necessary to have upper housing 852 be spaced a greater distance away from the exterior surface of the article than was necessary with respect to the bell jar 830 illustrated in FIG. 8A. Use of a retaining ring 856 makes this possible. The retaining ring 856 is sectioned into 2 or more sections such that it is easily removed from the protected article 880 without touching the sensitive surface 883. In FIG. 8B, the retaining ring 856 is sectioned into 3 sections. Upper housing 852 is fastened to base 854 by fasteners 857 which pass through openings 855 in retainer ring 856 and pass into or through apertures 853 in base 854.

The above described exemplary embodiments are not intended to limit the scope of the present invention, as one skilled in the art can, in view of the present disclosure expand such embodiments to correspond with the subject matter of the invention claimed below.

We claim:

1. A rigid non-contact package for shipping and storage in combination with an article having a sensitive surface which may be damaged by contact with said package, said combination comprising:

a base of said non-contact package, which base comprises a rigid material, wherein said base is designed to avoid contact with a sensitive surface of said article;

a rigid upper portion of said non-contact package which is designed to be attached to said base of said non-contact package in a manner which provides a package which completely encloses said article while not contacting said sensitive surface of said article;

a retention device which retains a non-sensitive surface of said article against said package base without contacting a sensitive surface of said article; and at least one fastening device which prevents an unplanned opening of said non-contact package during shipping and storage, and which enables opening of said non-contact package when desired without contact of said sensitive surface of said article.

2. A rigid non-contact package in accordance with claim 1, wherein said retention device is a flange of said upper portion of said package.

3. A rigid non-contact package in accordance with claim 1, wherein said retention device is a retention ring.

* * * * *